US010167163B2

(12) United States Patent
Chanclon Fernandez et al.

(10) Patent No.: US 10,167,163 B2
(45) Date of Patent: Jan. 1, 2019

(54) HANDOFF MECHANISM FOR A MEDIA PRODUCTION APPARATUS

(71) Applicant: HEWLETT-PACKARD DEVELOPMENT COMPANY, L.P., Houston, TX (US)

(72) Inventors: Ismael Chanclon Fernandez, Barcelona (ES); Daniel Gonzalez Perello, Barcelona (ES); Joseba Ormaechea Saracibar, Sant Cugat del Valles (ES); Xavier Miguel Royo, San Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/311,729

(22) PCT Filed: May 30, 2014

(86) PCT No.: PCT/EP2014/061284

§ 371 (c)(1),
(2) Date: Nov. 16, 2016

(87) PCT Pub. No.: WO2015/180799

PCT Pub. Date: Dec. 3, 2015

(65) Prior Publication Data

US 2017/0081141 A1 Mar. 23, 2017

(51) Int. Cl.
*B65H 31/26* (2006.01)
*B65H 31/02* (2006.01)
(Continued)

(52) U.S. Cl.
CPC ..... *B65H 31/26* (2013.01); *B65H 29/44* (2013.01); *B65H 31/02* (2013.01); *B65H 43/06* (2013.01);
(Continued)

(58) Field of Classification Search
CPC ..... B65H 31/26; B65H 29/44; B65H 31/02; B65H 43/06; B65H 2301/4212;
(Continued)

(56) References Cited

U.S. PATENT DOCUMENTS 5,226,743 A 7/1993 Jackson et al.
5,758,981 A 6/1998 Lesniak et al.
(Continued)

FOREIGN PATENT DOCUMENTS

CN 1440917 9/2003
JP S57156964 9/1982
(Continued)

*Primary Examiner* — David H Bollinger
(74) *Attorney, Agent, or Firm* — HP Inc. Patent Department

(57) ABSTRACT

A handoff mechanism for use with a media stacker of a media production apparatus comprises a plurality of kicker units (101) arranged across a width of the handoff mechanism. A common drive mechanism (103) is provided to move the plurality of kicker units (101) between a closed position and an open position. Each kicker unit (101), when in the closed position during use, applies a pressure to any media sheets that are already stacked in a stacker tray (105) while a new media sheet is being fed to the stacker tray. The pressure provided by each kicker unit (101) is independent of the pressure provided by the other kicker units (101).

20 Claims, 8 Drawing Sheets

(51) Int. Cl.
*B65H 43/06* (2006.01)
*B65H 29/44* (2006.01)

(52) U.S. Cl.
CPC ..... *B65H 2301/4212* (2013.01); *B65H 2301/42242* (2013.01); *B65H 2301/442* (2013.01); *B65H 2301/4422* (2013.01); *B65H 2403/41* (2013.01); *B65H 2403/421* (2013.01); *B65H 2405/11151* (2013.01); *B65H 2511/152* (2013.01); *B65H 2701/11312* (2013.01); *B65H 2701/1313* (2013.01); *B65H 2801/06* (2013.01)

(58) Field of Classification Search
CPC .... B65H 2301/42242; B65H 2301/442; B65H 2403/41; B65H 2403/421; B65H 2405/11151; B65H 2511/152; B65H 2701/11312; B65H 2701/1313; B65H 2801/06
See application file for complete search history.

(56) References Cited

U.S. PATENT DOCUMENTS

| | | | |
|---|---|---|---|
| 6,135,444 | A | 10/2000 | Padget |
| 6,394,442 | B1 | 5/2002 | Antinora et al. |
| 6,726,384 | B2 | 4/2004 | Allen et al. |
| 6,796,556 | B2 | 9/2004 | Robertson et al. |
| 6,825,864 | B2 | 11/2004 | Botten et al. |
| 8,282,205 | B2 | 10/2012 | Choi et al. |
| 2006/0208411 | A1 | 9/2006 | Saito et al. |
| 2013/0093134 | A1 | 4/2013 | Mizubata et al. |

FOREIGN PATENT DOCUMENTS

| | | |
|---|---|---|
| JP | H02106551 | 4/1990 |
| JP | 11301912 | 11/1999 |
| JP | H11301912 | 11/1999 |
| JP | 2007055752 | 3/2007 |
| JP | 2008156012 | 7/2008 |
| JP | 2013193880 | 9/2013 |
| WO | WO-2013112140 | 8/2013 |

HANDOFF MECHANISM FOR A MEDIA PRODUCTION APPARATUS

Media production apparatus, such as a printing apparatus, may comprise stackers for stacking printed media. The stackers may be integrated as part of the printer apparatus. Stackers may include a handoff mechanism for ensuring that a media sheet leaves the last traction roller of the mechanism robustly, and that media sheets are stacked on a printer output tray. Handoff mechanisms may comprise of either a toothed wheel that pushes the trailing edge of a media sheet, or a set of rigid fingers, known as kickers, that act together to push media forward and also help to keep the paper stacked on the output tray by exerting a certain pressure to the stacked media.

BRIEF DESCRIPTION OF THE DRAWINGS

For a better understanding of examples of the present invention, and to show more clearly how the examples may be carried into effect, reference will now be made, by way of example only, to the following drawings in which.

DETAILED DESCRIPTION

Figure 1:
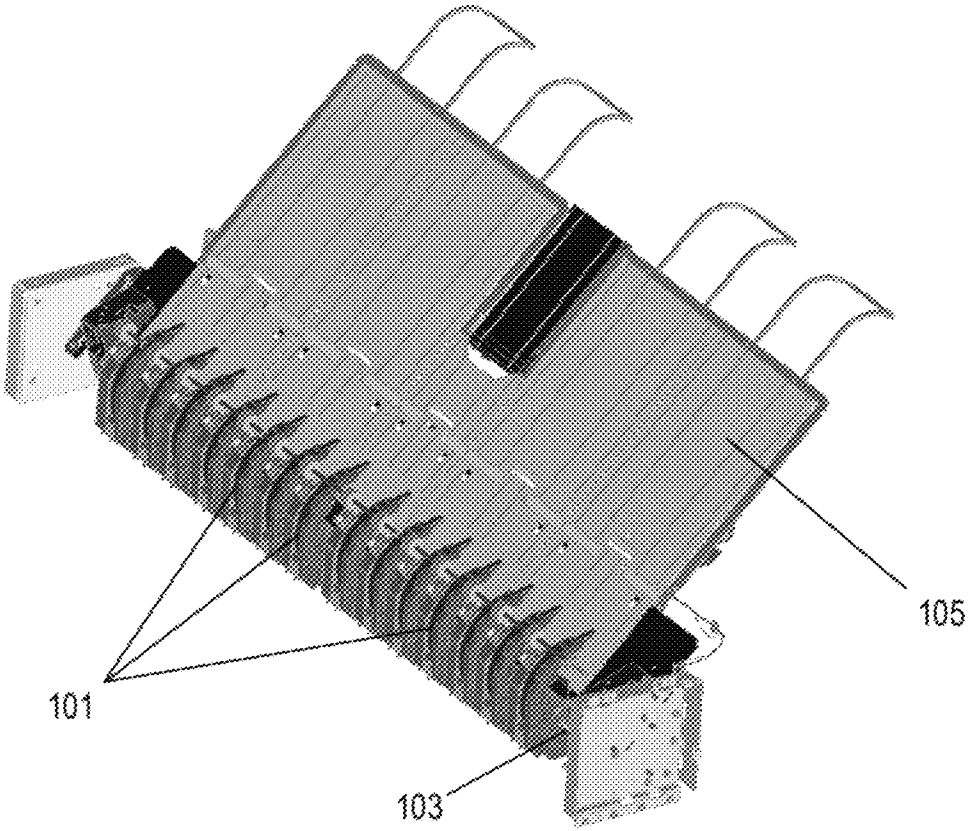
FIG. 1 shows an example of a handoff mechanism, part assembled with a stacker.

The examples described herein will be made in the context of printing apparatus. It is noted, however, that the examples are applicable to any form of media production apparatus, including imaged media production apparatus, such as printing apparatus, photocopying apparatus, and other forms of apparatus in which media sheets are to be output and stacked after internal processing.

Printer apparatus may comprise a stacker mechanism, and a stacker mechanism may comprise a handoff mechanism to control how media sheets are output from the printer apparatus and stacked on a stacker tray. A handoff mechanism may comprise a set of toothed wheels that help to push the trailing edge of a media sheet away from the last traction roller in the printer. Such a solution is relatively simple. However, in order to improve the reliability of such systems, in this type of arrangement a stacker tray that is long enough to hold the media on the stacker tray is used. Also, in this type of solution, any curling of the media during its handling needs to be very small, and the media sheets need to be very flat so that the trailing edge of a media sheet does not block an exit path of the media sheet.

In other printer formats, such as large format printers, integrated stacker trays tend to be much shorter than the length of the media sheet being printed, which means that the wheel solution described above may be less reliable for stacking media sheets. Moreover, in the case of inkjet printers, media tends to be curled to such an extent that the wheel solution becomes further unreliable. In such applications, a set of rigid fingers may be used in a handoff mechanism. This solution, apart from ensuring that the media leaves the last traction roller, also helps prevent curled media from blocking the exit path of the stacker, by pushing the trailing edge of the media sheet against the stacker tray. This provides the benefit of increasing friction of the already stacked media sheets, and prevents friction from the next media sheet being stacked, pushing the media sheets that are already stacked, which would otherwise cause the already stacked media sheets to fall down (which can be a particular issue when the stacker trays are shorter that the media sheets in large format printers).

In a known solution this type of handling mechanism is implemented by a series of rigid fingers actuated by a single motor. As such, the final location of the tip of each finger in the set of fingers is the same. Therefore, if variations exist in the sizes of media sheets being stacked (for example, media sheets of size A1, A2, A3), this leads to large variations in the pressure being applied across the width of the stacked media sheets, particularly where media sheets of different sizes overlap. This can lead to lack of friction in certain areas, and too much force in others, which can cause damage to the media sheets, particularly if different sized media sheets are used on the same stacker tray. The same disadvantageous effect can be caused by a stacker tray that has poor manufacturing tolerances across its width. High quality photo plots require glossy media, which is very sensitive to this pressure and very frequently is scratched by the type of rigid fingers provided in this type of handoff mechanism.

FIG. 1 shows an example of a handoff mechanism for use with a media production apparatus, for example a printer. The handoff mechanism comprises a plurality of kicker units 101 arranged across a width of the handoff mechanism, and a common drive mechanism 103 to move the plurality of kicker units 101 between a closed position and an open position. Each kicker unit 101, when in the closed position during use, applies a pressure to any media sheets that are already stacked in a stacker tray 105 while a new media sheet is being fed to the stacker tray. The pressure provided by each kicker unit 101 is independent of the pressure provided by the other kicker units 101.

The provision of a plurality of separate kickers units 101 which on the one hand are driven by the same common drive mechanism, and on the other apply an independent pressure, has the advantage that each kicker unit can provide its own pressure to its area of the stacker tray, such that if the stack contains media sheets of different widths, the pressure at each point is substantially constant or uniform. This has the advantage of avoiding excessive pressure in certain points, which would otherwise damage or mark the printed media.

It is noted that the width of the handoff mechanism corresponds to a direction which is orthogonal to the direction of the media as it travels through the printer apparatus. It is also noted that the closed position is a position where kicker units press or push against stacked media sheets, and the open position is a position in which a media sheet exists the last driver roller of the printer apparatus, and is in the process of being stacked. As a kicker unit 101 goes from an open position to the closed position, it pushes or kicks the paper onto stack, and then applies pressure to the stack as the next page is being output.

The handoff mechanism may comprise any number of kicker units arranged across its width, for example a series of 12 to 14 kicker units when used in an inkjet printer.

The plurality of kicker units 101 may be actuated by a single motor which moves a shaft with a cluster of gears, with these gears moving the plurality of fingers or kicker units together to perform the handoff of a trailing edge of the media sheet that is being expelled onto the stacker tray 105.

The plurality of kicker units also keep the media stack pressed against the stacker tray while the page that is being printed arrives to the stacker.

In order to ensure that the force the kicker unit applies on the media is substantially constant (regardless of the depth of media under a particular kicker unit), each kicker unit is formed from first and second main components, as will be described in further detail below.

Figure 2A:
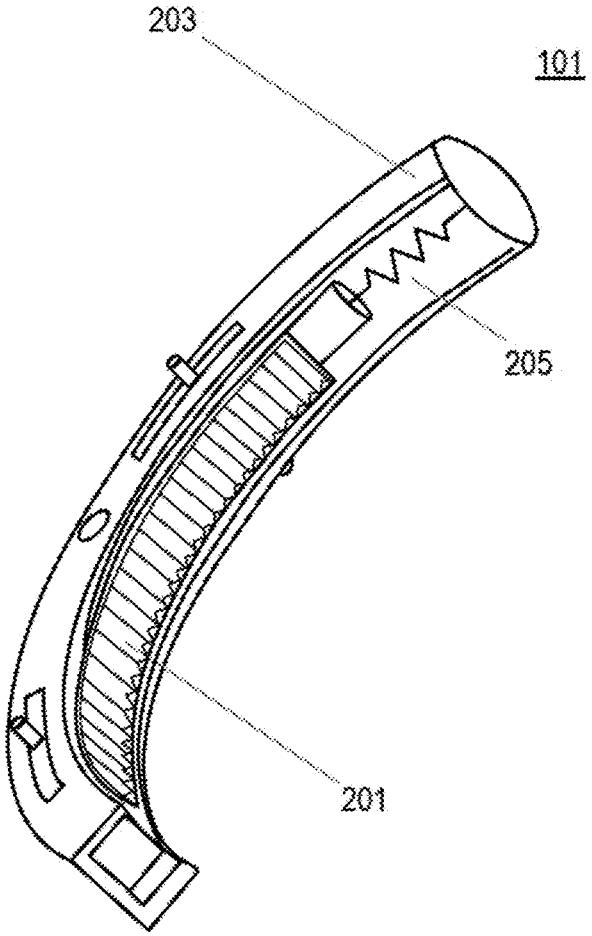
FIG. 2*a* shows an example of a kicker unit for use with a handoff mechanism.

Referring to FIG. 2*a*, this shows an example of a kicker unit 101 in further detail. The kicker unit 101 comprises a drive component 201 which, during use, is coupled to the common drive mechanism 103, to move the kicker element 101 between the closed position and the open position. A contact component 203 applies pressure, during use, to any media sheets already stacked in a stacker tray. The contact component 203 is moveable relative to the drive component 201. A first biasing element 205 is coupled between the drive component 201 and the contact component 203, to control movement of the contact component 203 relative to the drive component 201.

The contact component 203 is therefore effectively movably coupled to the drive component 201. As the drive component moves or is driven towards the closed position (i.e. in which the contact component 203 is to apply a pressure to stacked media), movement of the drive component 201 towards this closed position causes the contact component 203 to also move in this direction, for example by virtue of the drive component 201 pushing against the first biasing element 205, and the first biasing element 205 pushing against the contact component 203 to move it towards the closed position. As the tip or end of the contact component 203 starts to contact the media stacked in the stacker tray, the contact component 203 starts to retract backwards, against the movement of the drive component 201 towards the closed position. The extent to which the contact component 203 retracts is related to the amount of media already stacked in the stacker tray (i.e. according to the depth of the stacked media at that particular kicker unit). In this manner, if different widths of media are stacked on the stacker tray, each contact member 203 of each kicker unit will retract a different amount, depending on the depth of media under that particular kicker unit 101 (or on manufacturing tolerances of the depth of the stacker tray itself), such that the pressure applied by each kicker unit is independent of the pressure applied by the other kicker units. This has the advantage of enabling a relatively constant pressure to be applied across the width of the handoff mechanism.

In the example of FIG. 2*a* the kicker unit 101 is generally curved shape. The drive component 201 and the contact component 203 therefore move relative to one another about a common axis.

The force of the first biasing element 205 controls the pressure applied by the contact component 203 to any media sheets already stacked on the stacker tray, while the kicker unit 101 is in the closed position.

The force applied by the first biasing element 205 is low (or soft) enough to allow each kicker unit 101 to adapt to a particular depth of a media stack and/or any manufacturing tolerances of a stacker tray, but high (or strong) enough to sufficiently hold media sheets already stacked.

The first biasing element 205 may comprise, for example, a spring.

In the example of FIG. 2*a* the drive component 201 comprises a rack arrangement for engaging with a gear wheel of the common drive mechanism 103, and the contact component 203 comprises an envelope structure which surrounds the drive component 201, such that the drive component 201 is moveable within the contact component 203.

From the above it can be seen that a first section of the kicker unit comprises an internal rack arrangement, which is the portion of the kicker unit that is actuated, for example, by the gear cluster that activates the whole mechanism. The second section is a form of floating envelope, which is the section that finally pushes the media against the stacker tray. In between these sections, the spring controls the force or pressure that the envelope section makes against the stacked pages. Since the kicker units 101 are non-rigid, the pressure applied by each kicker unit 101 is independent of the pressure applied by other kicker units 101.

Figure 2B:
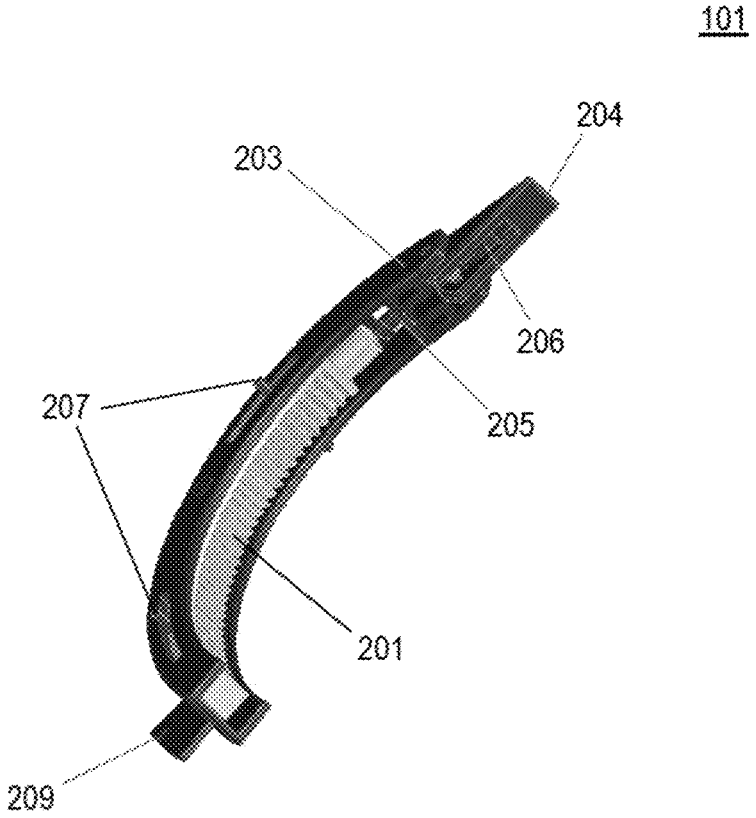
FIG. 2*b* shows another example of a kicker unit.

FIG. 2*b* shows another example, which is similar to FIG. 2*a*, and comprises many common components as described above. The contact component 203 comprises at least one slot, and the drive component comprises at least one guide pin 207. A guide pin 207 moves within the corresponding slot to guide the movement of the drive component 201 relative to the contact component 203.

The slot functions to allow the drive component 201 to move relative to the contact component 203, and enables the contact component 203 to retract as pressure is exerted against the tip of the contact component 203 (i.e. pressure exerted by the media sheets already stacked in the stacker tray). These features may also be provided in the example of FIG. 2*a*.

According to a further aspect, a self retracting mechanism can be added to any of the examples described herein, to facilitate the return movements of the kicker units 101 towards the closed position. The handoff concept of kicker units involves a mechanism that moves in two directions: one forward (to a closed position) and another backwards (to the open position). In order to reduce the movements of the motor (i.e. avoid the motor having to drive in two opposite directions to move the kicker units in these two directions), examples may be implemented with a linkage mechanism to provide a self retracting movement.

It is noted that, according to one example, the handoff mechanism comprises a linkage mechanism to enable the kicker units 101 to move from the closed position to the open position, and from the open position to the closed position, in response to a motor of the common drive mechanism 103 rotating in a single direction, i.e. the same direction.

In such an example the linkage mechanism may comprise a toothed gear wheel driven by the common drive mechanism 103, for driving a rack arrangement on the drive component 201, wherein the toothed gear wheel comprises a plurality of missing teeth, and a second biasing element for tensioning the kicker unit 101 towards the closed position.

This arrangement has the advantage of enabling the toothed gear wheel to drive the kicker unit towards the open position, and then when the toothless portion of the gear wheel is reached, the second biasing element, for example a spring, causes the kicker unit to return to the closed position.

In such an example the second biasing element is selected to be stronger than the first biasing element, such that when the second biasing element pulls the kicker unit towards the closed position, the weaker first biasing element allows the contact component 203 to retract away from the media. In such an example the strengths of the first biasing element and second biasing element will be inter-dependent. Thus, if a spring or other biasing element is used to self retract the kicker unit, it is selected to be stronger than the first spring or biasing element to ensure that the first spring is compressed. According to one example, a limit or end of travel may be provided for the second biasing element being used for self-retraction, and once it arrives at that point, the first biasing element takes effect.

Other arrangements can be used to provide the same function in other examples, such as a cam-follower, or crank-slider configuration.

This aspect provides further advantages. For example, the number of motor activations can be reduced when implementing the self-retracting feature. This can increase system life, reduce overheating of a motor and improve the reliability of the mechanism. This aspect also enables smaller, less powerful motors to be used for activating the kicker units, which provides further cost saving advantages.

In the example of FIG. 2*b*, a first end of the contact component 203 which, in use contacts any media sheets in the stacker tray, comprises a pivotable section 204.

This pivotable section 204, or kicker tip, allows the kicker unit 101 to adapt better to the stack, as the stack is increased. It also helps to push the trailing edge of the next media sheet being added to the stacker tray, as the kicker unit moves from an open position to the closed position, as will be described later in the application.

The pivotable section 204 may be biased by a third biasing element 206. As mentioned above, this has the advantage of biasing or pushing a trailing edge of a media sheet to expel the media sheet outside the printer, as the pivotable section rotates and comes behind the trailing edge of the media.

Figure 3:
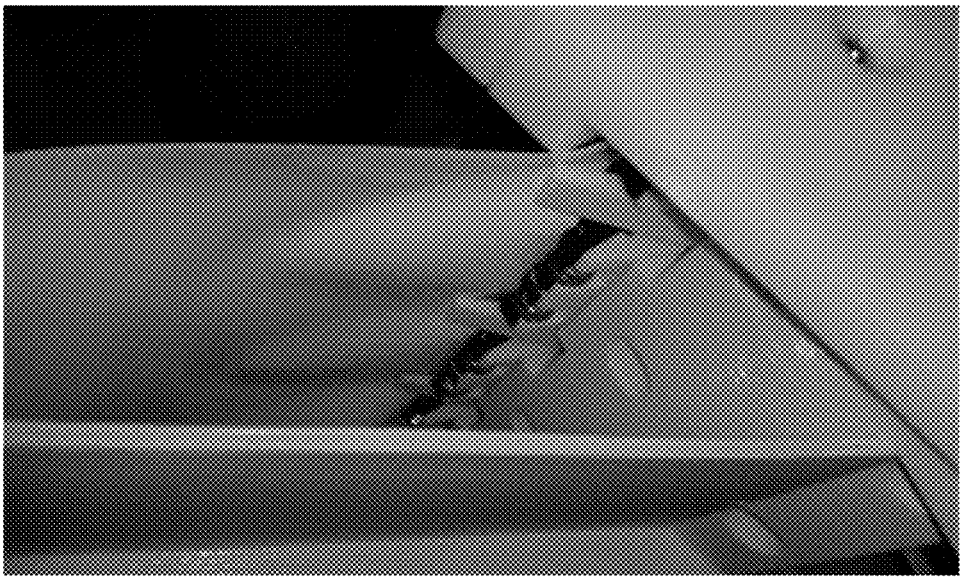
FIG. 3 shows a stacker mechanism.

Thus, in some applications a kicker unit may comprise an additional part coupled to the tip of the envelope section in order to better adapt to the stack, as shown in FIG. 2*b*. A pivoting tip may be provided in some applications to help the handoff of the media due to the particular configuration of the exit rollers. This has the advantage of avoiding the media becoming stuck in last traction roller of a stacker, for example as shown in FIG. 3. However, in other applications, where cost is an issue, this tip can be replaced by just a fixed geometry, for example a rounded geometry, on the end of the envelope section (contact component section 203), as shown in FIG. 2*a*.

The pivoting tip 204 mounted on a flexible spring 206 helps to push the media and expel it outside the printer in view of the tip being able to rotate and come behind the trailing edge of the media. In this way, when the kicker units are activated, they push the media and help with handoff.

Figure 4:
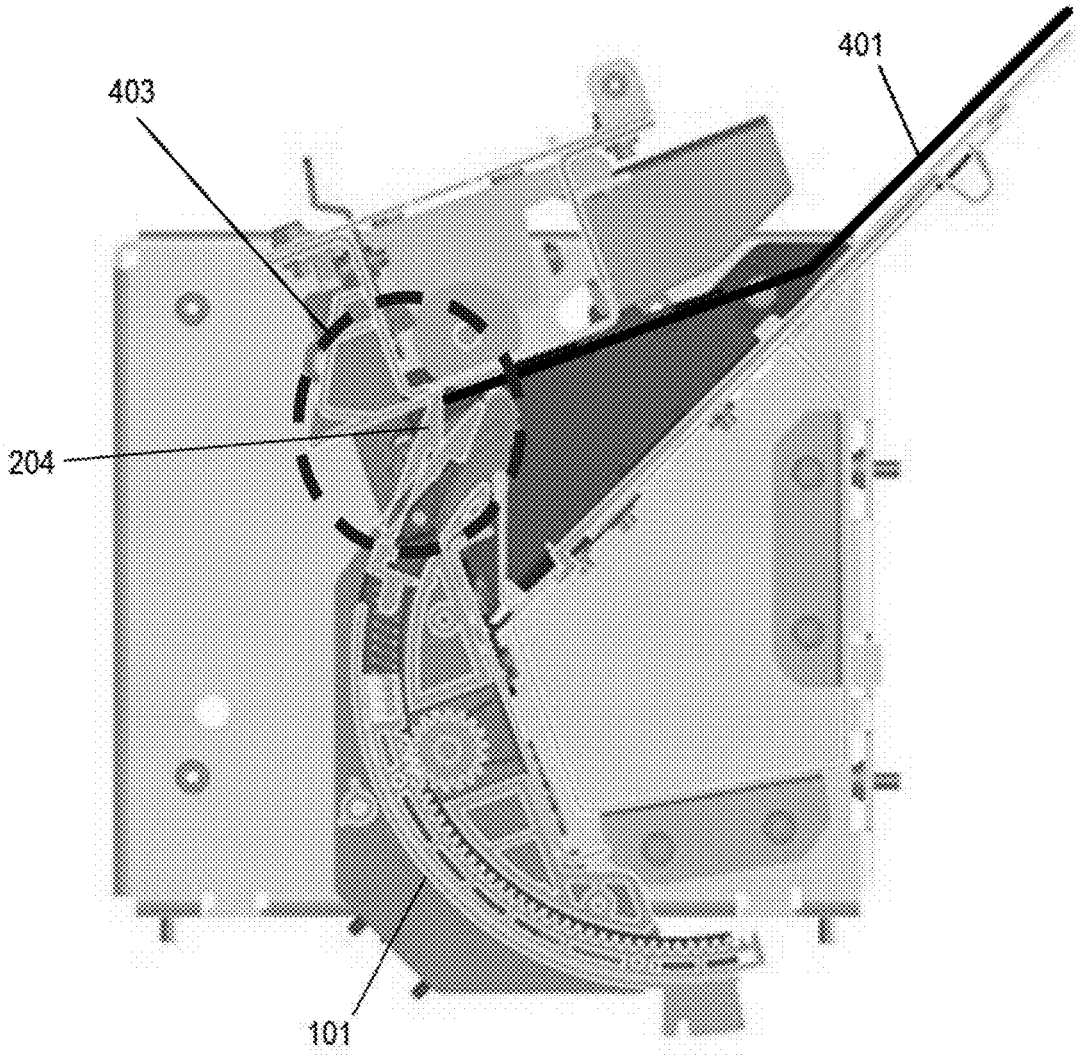
FIG. 4 shows an example of a handoff mechanism during use.

FIG. 4 shows an example of a kicker unit 161 according to an example during use, and in particular how the pivotable section 204 of the kicker unit 101 can help expel a media sheet 401 as it exits a final roller of the printer apparatus, this movement of the pivotable section 204 being shown within the dotted lines 403.

Referring to FIG. 2*b* once more, according to a further example, the contact component 203 comprises an indicator element 209 to indicate the fill status of the stacker tray.

Since the distance by which the contact component 203 retracts is dependent on the amount of media sheets loaded on the stacker tray, providing an indicator element 209 on the contact member enables the stack fill status of the stacker tray to be determined.

The indicator element 209 may comprise a protrusion for flag) located, for example, at a second end of the contact component 203, whereby the protrusion 209, in use, cooperates with a sensor for indicating whether a maximum stacker capacity has been achieved.

The sensor may comprise an optical sensor, for example, which is positioned to detect the present or absence of the protrusion or flag 209 in a particular position that corresponds to a "stacker tray full" position. As another example, an optical sensor can be used to detect the presence or absence of a hole in a feature or face of the contact component 203. A further example may be to detect a reflective surface or a change in color or brightness of a particular feature. Alternatively, the indicator element 209 may comprise an electrical component, such as a magnetic device, which cooperates with a hall effect sensor for detecting the position of the protrusion. Other types of indicator/sensor may also be used.

It is noted that the flag 209 could also be located elsewhere, so long as it provides an indication of where the contact component 203 is located when in the closed position and the stacker tray being full.

Thus, the two-section arrangement, for example the rack and envelope configuration, also has the advantage of easily implementing a feature to detect that the maximum stacker capacity has been achieved. By adding a flag to the envelope (contact component), this can be monitored with a sensor, such as an optical sensor, to provide an accurate method to know the depth of the stack on the stacker tray, which can be used to inform the user that the maximum capacity of the stacker has been achieved.

According to another aspect, there is provided a kicker unit 101 for use with a handoff mechanism of a media production apparatus (for example a printer apparatus). The kicker unit 101 comprises a drive component 201 coupled to the common drive mechanism 103, to move the kicker element 101 between the closed position and the open position, and a contact component 203 which, in use, applies pressure to any media sheets already stacked in a stacker tray. The contact component 203 is moveable relative to the drive component 201. A first biasing element 205 is coupled between the drive component 201 and the contact component 203, to control movement of the contact component 203 relative to the drive component 201, such that when the kicker unit is in a closed position during use, the contact component 203 applies a pressure to any media sheets that are already stacked in a stacker tray 105 while a new media sheet is being fed to the stacker tray, and wherein the pressure provided by the kicker unit 101 is independent of the pressure provided by other kicker units 101 of the handoff mechanism.

The kicker unit 101 may have any of the other features described above in relation to FIGS. 2*a* and 2*b*.

According to another aspect, there is provided a printer apparatus comprising a handoff mechanism as described in any of the examples above, and as defined in the appended claims.

The examples described herein have the advantage of not exerting pressure that may end up damaging the media sheets, thereby improving the quality of the printed media sheets.

The examples have the further advantage that, if different sizes of media are to be stacked at the same time, for example media sheets of the A1, A2 and A3 type, the kicker units according to the examples enable an even pressure to be provided, regardless of whether certain areas where the shorter plots are stacked has a different thickness to other areas.

The examples comprise a compliant system which delivers a well controlled force at any of the kickers units, improving quality of stack by efficiently preventing damage on the plots and on the paper. In this way various advantages are provided to users, such as the ability to use different sized media sheets robustly. The examples also have the advantage of allows stacker trays with wider tolerances to be used with the handoff mechanism, thus enabling a cost reduction on the overall system. Furthermore, examples include the possibility of adding a self-retracting feature that reduces the number of motor actuations when using the kicker units. In this way, the motor suffers less and may be replaced by a smaller, cheaper motor, allowing the possibility of further cost-reduction. Also, the provision of an indicator element or flag enables an effective and robust method of detecting stack fill status to be achieved.

The structure of the examples described above provide a handoff mechanism that, when stacking media in a printer, avoids media jams caused by a trailing edge of a media sheet blocking an exit channel after the last traction roller in the stacker, whereby a kicker unit acts to push the trailing edge of the media sheet, thereby clearing the exit channel.

In addition, if a relatively short tray is implemented (which is typical in a large format printer), the examples described above prevent the stack from falling down when a new sheet is added. When a new page is stacked, the new page moves upwards on the stacker tray. This new page that is being stacked generates a friction with a page that was previously stacked. If the friction is sufficiently high, it could result in both pages sticking together, which could cause the previously stacked page to be pushed upwards, causing it to fall down from the stacking tray. This effect is commonly known as "bulldozing". However, the handoff mechanism and kicker units according to the examples described above prevent or reduce this undesired bulldozing effect, by pushing down and effectively holding the already stacked media in place, while a new page is added to the stack, but in a manner that is less likely to damage the stacked media, for example less likely to cause tearing-off of media when large differences in width occur. This is particularly advantageous when using media with low rigidity, for example bond or NTP type media.

From the examples described above, it can be appreciated that a handling mechanism according to the examples prevent or reduce damage to stacked media sheets, that would otherwise be caused by a series of rigid or fixed kickers that apply the same pressure across the entire width of the printer apparatus.

The examples described herein have the advantage of ensuring a substantially constant pressure of all kickers, regardless of how many layers of media sheets may be stacked under a particular kicker (i.e. due to different media sizes), thereby providing a uniform pressure (or subjection force) across the whole width, and whereby the pressure applied by each kicker unit is independent of the pressure applied by another kicker unit. The pressure applied by a kicker unit of an example described herein is effectively independent of the drive force being exerted by the common drive mechanism. In other words, although a common drive mechanism is driving each of the kicker units in the same way, and with the same force or pressure, each kicker unit can be configured to retract against the drive force according to the depth of stacked media and/or tolerances of a unit upon which the media is stacked, such as a stacker tray.

Since each kicker unit can provide a pressure which is independent of the other kickers, this also has the advantage of providing cost reduction in relation to a stacker tray itself. This is because manufacturing tolerances in the production of stacker trays can be absorbed by the handling mechanism according to the examples. Stacker trays tend to be very long sheet metal parts that have wide manufacturing tolerances. The examples described herein absorb this variability, and therefore enable cheaper parts with wider tolerances to be used, thus reducing the overall cost of a stacker tray and stacker mechanism.

Figure 5A:
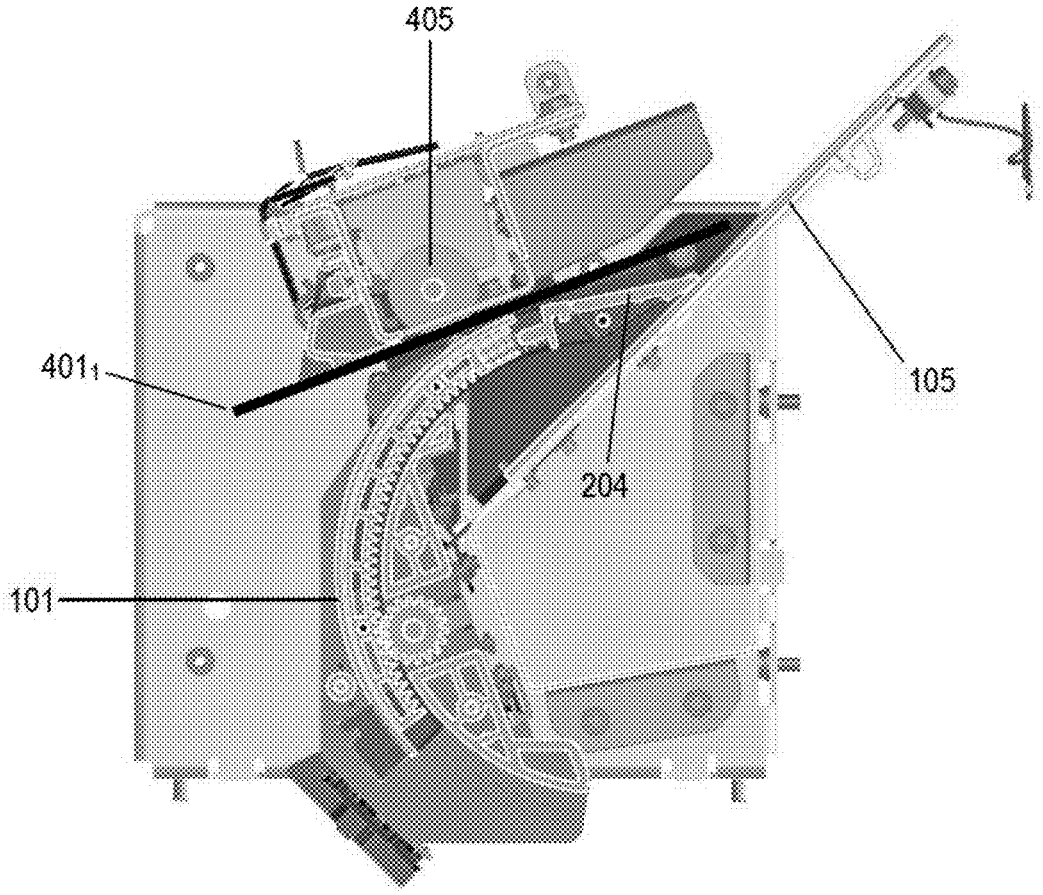
FIGS. 5*a* to 5*c* show further examples of a handoff mechanism during use.
Figure 5B:
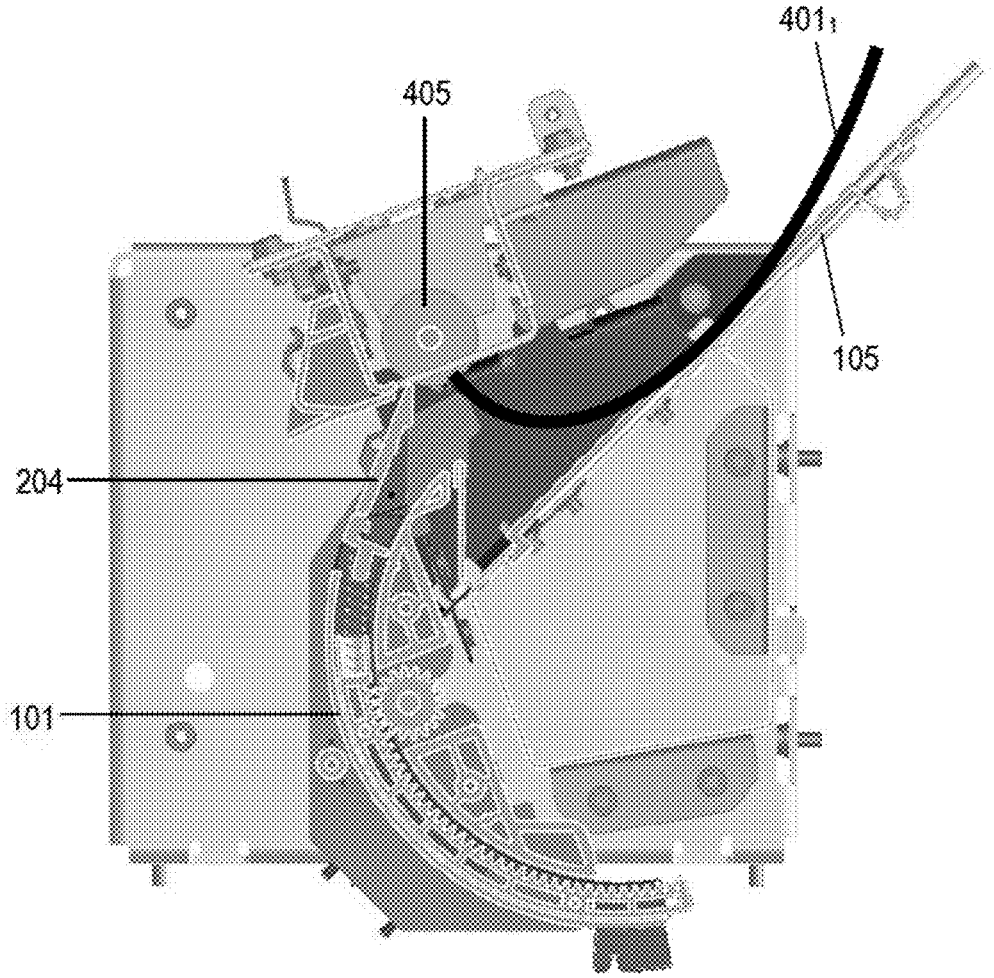
Figure 5C:
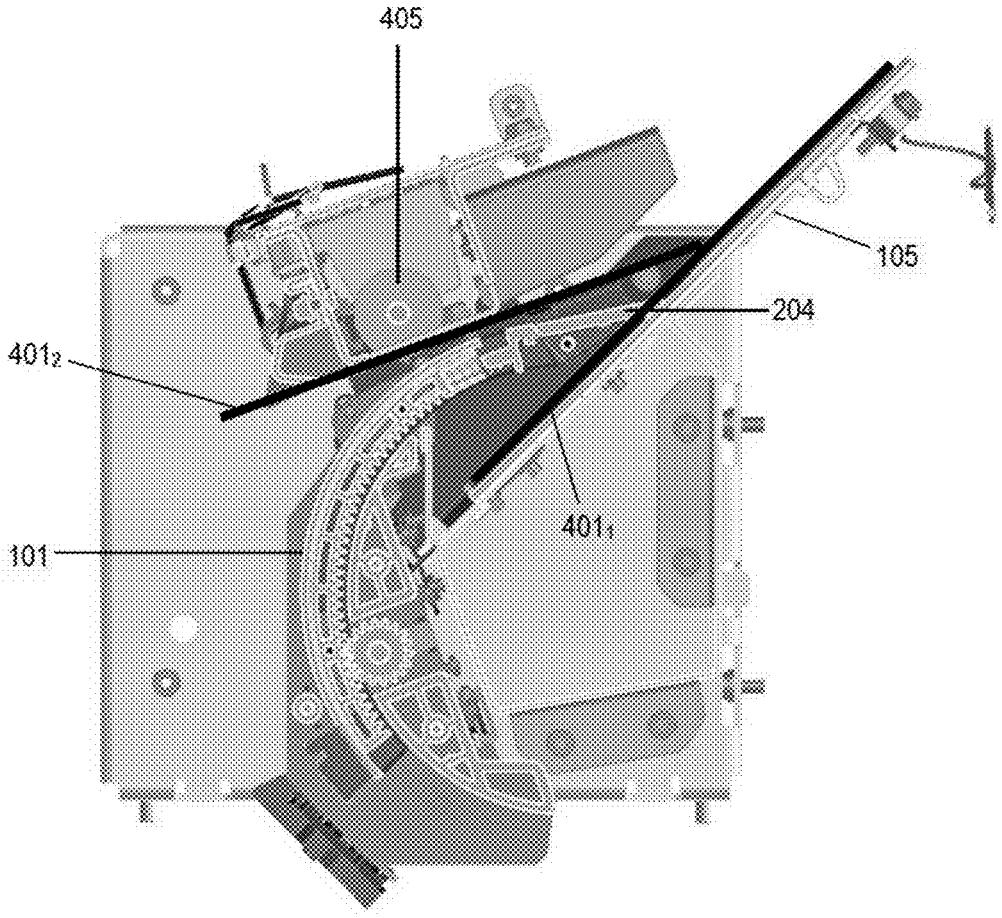

FIGS. 5*a* to 5*c* describe an example of the operation of a printer apparatus comprising a handoff mechanism according to the examples described above.

Referring to FIG. 5*a*, in a first step, a media sheet $\mathbf{401}_1$ enters the media path, and is pushed by the last traction roller 405 in the printer. During this step the kicker units 101 are in the closed position, as shown, with the pivotable section 204 of the kicker unit 101 applying pressure to any media sheets already stacked in the stacker tray 105 (noted that no media sheets are shown as being already stacked in this example at this stage).

Referring to FIG. 5*b*, in a second step, once the trailing edge of the media sheet $\mathbf{401}_1$ leaves the traction roller 405, the kicker units 101 are moved to an open position. It is noted that curling of the media $\mathbf{401}_1$ tends to close the media path, as shown.

Referring to FIG. 5*c*, the kickers units 101 are then moved to a closed position, clearing the media path for the next media sheet $\mathbf{401}_2$. The next media sheet $\mathbf{401}_2$ arrives, and while in this closed position the kicker units 101 also press the previously stacked media sheet $\mathbf{401}_1$ (and any media sheets stacked prior to that), in order to prevent the next media sheet $\mathbf{401}_2$ from pushing the already stacked page(s) out of the stacker tray 105.

These cycles of FIGS. 5*a* to 5*c* are then repeated.

The examples described above have the advantage of providing robust size mixing of stacked pages for improving user experience. Jobs stored in the stacker can include confidently unlimited width types. The possibility of causing damage on plots already stacked is reduced, and improved quality can be provided due to mark-free plots stored in the stacker, particularly in high quality media such as photo and glossy media. Compliant accommodation of paper stack allows uniform and lower forces in media to support them in a stacker. There is a lower risk of tear up or bends in low rigidity media. Higher manufacturing tolerances in all parts is enabled, thus providing cost reduction, with additional cost reductions being possible through the implementation of kicker units having a self-retracting mechanism. The examples also provide an easy, inexpensive, robust and accurate implementation of maximum stack capacity detection. Integrating a flag in an external envelope provides a feature to robustly detect that maximum capacity of stacker has been achieved, providing useful information to users.

Although the examples described above show a kicker unit 101 in which a contact component 203 forms an envelope type structure around an internal drive component 201, it is noted that this arrangement could be reversed or altered while still achieving the same effect, for example whereby the rack arrangement forms part of an outer shell or envelope, with a contact component located within this outer shell, the contact component protruding from the end of the drive component, with a spring positioned between the two elements.

It should be noted that the above-mentioned examples illustrate rather than limit the invention, and that those skilled in the art will be able to design many alternative examples without departing from the scope of the appended claims. The word "comprising" does not exclude the presence of elements or steps other than those listed in a claim, "a" or "an" does not exclude a plurality, and a single unit may fulfil the functions of several units recited in the claims. Any reference signs in the claims shall not be construed so as to limit their scope.

The invention claimed is:

1. A handoff mechanism for use with a media stacker of a media production apparatus, the handoff mechanism comprising:

a plurality of kicker units arranged across a width of the handoff mechanism;

a common drive mechanism to move the plurality of kicker units between a closed position and an open position;

whereby each kicker unit, when in the closed position during use, applies a pressure to any media sheets that are already stacked in a stacker tray while a new media sheet is being fed to the stacker tray, and wherein the pressure provided by each kicker unit is independent of the pressure provided by the other kicker units.

2. A handoff mechanism as claimed in claim 1, wherein a kicker unit comprises:

a drive component coupled to the common drive mechanism, to move a kicker element between the closed position and the open position;

a contact component which, in use, applies pressure to any media sheets already stacked in a stacker tray, wherein the contact component is moveable relative to the drive component; and a first biasing element coupled between the drive component and the contact component, to control movement of the contact component relative to the drive component.

3. A handoff mechanism as claimed 2, wherein the drive component and the contact component move relative to one another about a common axis.

4. A handoff mechanism as claimed in claim 2, wherein the force of the first biasing element controls the pressure applied by the contact component to any media sheets already stacked on the stacker tray, while the kicker unit is in the closed position.

5. A handoff mechanism as claimed in claim 4, wherein the force applied by the first biasing element is low enough to allow each kicker unit to adapt to a particular depth of a media stack and/or any manufacturing tolerances of a stacker tray, but high enough to sufficiently hold media sheets already stacked.

6. A handoff mechanism as claimed in claim 2, wherein the first biasing element comprises a spring.

7. A handoff mechanism as claimed in claim 2, wherein:

the drive component comprises a rack arrangement to engage with a gear wheel of the common drive mechanism; and the contact component comprises an envelope structure which surrounds the drive component, such that the drive component is moveable within the contact component.

8. A handoff mechanism as claimed in claim 7, wherein the contact component comprises at least one slot, and the drive component comprises at least one guide pin, wherein a guide pin moves within the slot to guide the movement of the drive component relative to the contact component.

9. A handoff mechanism as claimed in claim 2, wherein a first end of the contact component which, in use, contacts any media sheets in the stacker tray, comprises a pivotable section.

10. A handoff mechanism as claimed in claim 2, wherein the contact component comprises an indicator element to indicate the fill status of the stacker tray.

11. A handoff mechanism as claimed in claim 10, wherein the indicator element comprises a protrusion or an opening located at a second end of the contact component, whereby the protrusion or opening, in use, cooperates with a sensor to indicate whether a maximum stacker capacity has been achieved.

12. A handoff mechanism as claimed in claim 1, further comprising a linkage mechanism to enable the kicker units to move from the closed position to the open position, and from the open position to the closed position, in response to a motor of the common drive mechanism rotating in a single direction.

13. A handoff mechanism as claimed in claim 12 wherein the linkage mechanism comprises;

a toothed gear wheel driven by the common drive mechanism, to drive a rack arrangement on the drive component, wherein the toothed gear wheel comprises a plurality of missing teeth; and a second biasing element to tension the kicker unit towards the closed position.

14. A kicker unit for use with a handoff mechanism of a media production apparatus, the kicker unit comprising:

a drive component coupled to a common drive mechanism, to move the kicker element between a closed position and an open position;

a contact component which, in use, applies pressure to any media sheets already stacked in a stacker tray, wherein the contact component is moveable relative to the drive component; and a first biasing element coupled between the drive component and the contact component, to control movement of the contact component relative to the drive component, such that when the kicker unit is in a closed position during use, the contact component applies a pressure to any media sheets that are already stacked in a stacker tray while a new media sheet is being fed to the stacker tray, and wherein the pressure provided by the kicker unit is independent of the pressure provided by other kicker units of the handoff mechanism.

15. A kicker unit as claimed in claim 14, wherein the drive component and the contact component move relative to one another about a common axis.

16. A kicker unit as claimed in claim 14, wherein a force of the first biasing element controls the pressure applied by the contact component to any media sheets already stacked on the stacker tray, while the kicker unit is in the closed position.

17. A kicker unit as claimed in claim 14, wherein a force applied by the first biasing element is low enough to allow the kicker unit to accommodate different depths of a media stack and/or any manufacturing tolerances of a stacker tray, but high enough to sufficiently hold media sheets already stacked.

18. A kicker unit as claimed in claim 14, wherein the first biasing element comprises a spring.

19. A printer apparatus comprising a handoff mechanism for use with a media stacker of a media production apparatus, the handoff mechanism comprising:

a plurality of kicker units arranged across a width of the handoff mechanism;

a common drive mechanism to move the plurality of kicker units between a closed position and an open position;

whereby each kicker unit, when in the closed position during use, applies a pressure to any media sheets that are already stacked in a stacker tray while a new media sheet is being fed to the stacker tray, and wherein the pressure provided by each kicker unit is independent of the pressure provided by the other kicker units.

20. A printer apparatus as claimed in claim 19, wherein each kicker unit comprises:

a drive component coupled to a common drive mechanism, to move the kicker element between a closed position and an open position;

a contact component which, in use, applies pressure to any media sheets already stacked in a stacker tray, wherein the contact component is moveable relative to the drive component; and a first biasing element coupled between the drive component and the contact component, to control movement of the contact component relative to the drive component, such that when the kicker unit is in a closed position during use, the contact component applies a pressure to any media sheets that are already stacked in a stacker tray while a new media sheet is being fed to the stacker tray, and wherein the pressure provided by the kicker unit is independent of the pressure provided by other kicker units of the handoff mechanism.

* * * * *